US012680735B2

(12) United States Patent
Stroud

(10) Patent No.: US 12,680,735 B2
(45) Date of Patent: Jul. 14, 2026

(54) SYSTEMS AND METHODS OF HEATING AND COOLING CYCLE WITH ISOCHORIC HEATING

(71) Applicant: Icebox Heat Pumps Inc., Petaluma, CA (US)

(72) Inventor: Matthew Stroud, Petaluma, CA (US)

(73) Assignee: Icebox Heat Pumps Inc., Petaluma, CA (US)

( * ) Notice: Subject to any disclaimer, the term of this patent is extended or adjusted under 35 U.S.C. 154(b) by 277 days.

(21) Appl. No.: 18/539,189

(22) Filed: Dec. 13, 2023

(65) Prior Publication Data

US 2024/0200833 A1 Jun. 20, 2024

Related U.S. Application Data

(60) Provisional application No. 63/432,527, filed on Dec. 14, 2022.

(51) Int. Cl.
*F25B 13/00* (2006.01)

(52) U.S. Cl.
CPC ..... *F25B 13/00* (2013.01)

(58) Field of Classification Search
CPC ..... F25B 13/00; F25B 2309/061; F25B 2400/12; F25B 11/02; F25B 9/08; F25B 2313/008; F25B 29/003; F24D 2200/24; F28D 2021/0068; B60H 2001/3248
See application file for complete search history.

(56) References Cited

U.S. PATENT DOCUMENTS 5,121,610 A 6/1992 Atkinson et al.
5,245,836 A 9/1993 Lorentzen et al.
5,497,631 A 3/1996 Lorentzen et al.
5,581,883 A 12/1996 Matambo et al.
(Continued)

FOREIGN PATENT DOCUMENTS

AU 2017276308 A1 7/2018
CA 2018250 C 12/2001
(Continued)

OTHER PUBLICATIONS

International Application No. PCT/US2023/083932, International Search Report and the Written Opinion, dated Apr. 8, 2024, 12 pages.

*Primary Examiner* — Elizabeth J Martin
(74) *Attorney, Agent, or Firm* — Ahmann Kloke LLP

(57) ABSTRACT

An example method of a cooling cycle comprises compressing a refrigerant at a first state to a second state, the first state being at a first temperature and a first pressure, the second state being at a second temperature and a second pressure, the refrigerant at the initial state being at a particular bulk density, cooling the refrigerant at the second temperature and the second pressure to a third temperature, the cooling of the refrigerant being at a constant pressure, expanding the refrigerant at the third temperature and the second pressure to a fourth temperature, the fourth temperature being less than the third temperature, the fourth temperature corresponding to a third state where the refrigerant is at the particular bulk density, and heating the refrigerant at the fourth temperature to the first temperature at the particular bulk density that is constant from the third state to the first state.

21 Claims, 9 Drawing Sheets

(56) References Cited

U.S. PATENT DOCUMENTS

| | | | | |
|---|---|---|---|---|
| 5,615,559 | A | 4/1997 | Kress et al. | |
| 5,655,378 | A * | 8/1997 | Pettersen | F25B 1/00 62/174 |
| 5,924,305 | A | 7/1999 | Hill | |
| 6,000,233 | A * | 12/1999 | Nishida | F25B 9/008 62/470 |
| 6,112,547 | A | 9/2000 | Spauschus et al. | |
| 6,116,330 | A | 9/2000 | Salyer | |
| RE36,951 | E | 11/2000 | Cooper et al. | |
| 6,945,066 | B2 | 9/2005 | Hiwata et al. | |
| 6,966,198 | B2 | 11/2005 | Piccirilli et al. | |
| 7,152,428 | B2 | 12/2006 | Lee et al. | |
| 7,159,416 | B2 | 1/2007 | Park | |
| 7,210,303 | B2 | 5/2007 | Zhang et al. | |
| 7,434,414 | B2 | 10/2008 | Sakitani et al. | |
| 7,530,235 | B2 | 5/2009 | Yamaguchi et al. | |
| 7,647,790 | B2 | 1/2010 | Ignatiev et al. | |
| 7,811,071 | B2 | 10/2010 | Fontaine et al. | |
| 7,845,190 | B2 | 12/2010 | Pearson | |
| 8,141,381 | B2 | 3/2012 | Ino et al. | |
| RE43,312 | E | 4/2012 | Nakatani et al. | |
| 8,181,478 | B2 | 5/2012 | Ignatiev | |
| 8,393,169 | B2 | 3/2013 | Pham | |
| 8,424,284 | B2 | 4/2013 | Staffend et al. | |
| 8,863,724 | B2 | 10/2014 | Shkolnik et al. | |
| 9,038,390 | B1 | 5/2015 | Kreuger | |
| 9,062,898 | B2 | 6/2015 | Held et al. | |
| 9,194,615 | B2 | 11/2015 | Lesmerises et al. | |
| 9,671,144 | B1 | 6/2017 | El-Shaarawi | |
| 9,739,519 | B2 | 8/2017 | Gan et al. | |
| 9,777,950 | B2 | 10/2017 | Uselton | |
| 9,835,083 | B2 | 12/2017 | Cunningham et al. | |
| 9,845,998 | B2 | 12/2017 | Kreuger | |
| 10,703,174 | B2 | 7/2020 | Dykes et al. | |
| 10,731,554 | B2 | 8/2020 | Lear, Jr. | |
| 10,801,757 | B2 | 10/2020 | Hellmann | |
| 10,934,971 | B2 | 3/2021 | Marko | |
| 11,208,583 | B1 | 12/2021 | Couchot et al. | |
| 11,230,948 | B2 | 1/2022 | McAuliffe et al. | |
| 2001/0050163 | A1 | 12/2001 | Iwamoto et al. | |
| 2006/0123827 | A1 | 6/2006 | Achaichia | |
| 2007/0151266 | A1 | 7/2007 | Yakumaru et al. | |
| 2008/0289344 | A1 | 11/2008 | Bonte et al. | |
| 2008/0302122 | A1 | 12/2008 | Inoue et al. | |
| 2009/0105889 | A1 * | 4/2009 | Cowans | F25B 40/00 700/299 |
| 2010/0031677 | A1 | 2/2010 | Lifson et al. | |
| 2012/0318001 | A1 | 12/2012 | Takayama et al. | |
| 2014/0298833 | A1 | 10/2014 | Lesmerises et al. | |
| 2015/0114031 | A1 | 4/2015 | Ignatiev | |
| 2015/0300713 | A1 | 10/2015 | Sun et al. | |
| 2016/0138847 | A1 | 5/2016 | Zimmermann | |
| 2017/0051950 | A1 | 2/2017 | Uselton | |
| 2017/0314830 | A1 | 11/2017 | Klemen et al. | |
| 2017/0356681 | A1 | 12/2017 | Douven et al. | |
| 2018/0017295 | A1 | 1/2018 | Pelsemaeker et al. | |
| 2018/0128270 | A1 | 5/2018 | Koyama et al. | |
| 2018/0274823 | A1 | 9/2018 | Rajendiran et al. | |
| 2020/0018193 | A1 | 1/2020 | Neiser | |
| 2020/0025127 | A1 | 1/2020 | Marko | |
| 2020/0217562 | A1 | 7/2020 | Sun et al. | |
| 2020/0256602 | A1 | 8/2020 | Zha | |
| 2020/0292240 | A1 | 9/2020 | Chase | |
| 2021/0087949 | A1 | 3/2021 | Han et al. | |
| 2021/0254864 | A1 | 8/2021 | Cavalleri et al. | |
| 2021/0254865 | A1 | 8/2021 | Overelv | |
| 2021/0270498 | A1 | 9/2021 | Ma | |
| 2021/0364198 | A1 | 11/2021 | Bittner | |
| 2021/0372678 | A1 | 12/2021 | Engen | |
| 2021/0404711 | A1 * | 12/2021 | Nomoto | F25B 23/006 |

FOREIGN PATENT DOCUMENTS

| | | | |
|---|---|---|---|
| CA | 2738874 | C | 7/2012 |
| CA | 2820930 | C | 4/2016 |
| CA | 2899277 | C | 7/2018 |
| CN | 101124438 | B | 8/2010 |
| CN | 204492895 | U | 7/2015 |
| CN | 104896750 | A | 9/2015 |
| CN | 104949390 | B | 10/2017 |
| CN | 104990169 | B | 9/2018 |
| CN | 113465200 | A | 10/2021 |
| EP | 0424474 | B1 | 8/1993 |
| EP | 0672233 | B1 | 11/1997 |
| EP | 2054677 | B1 | 6/2018 |
| EP | 3071904 | B1 | 5/2019 |
| JP | 2009008383 | A | 1/2009 |
| WO | 1990007683 | | 7/1990 |
| WO | 2008130358 | A1 | 10/2008 |
| WO | 2018200706 | A1 | 11/2018 |

* cited by examiner

100

| Refrigerant | Cons | Category |
|---|---|---|
| R-22 | Ozone depleting, 1,810 GWP* | Legacy synthetic |
| R-134a | 1,430 GWP, toxic byproducts if overheated | |
| R-1234yf | Toxic decomposition byproducts | Replacement synthetic |
| R-1234ze | Very high GWP decomposition byproducts | |
| R-32 | Flammable, toxic decomposition byproducts, 675 GWP | |
| Propane | Explosive, illegal to use in several applications | Natural |
| Ammonia | Toxic, flammable | |
| Air | Very low energy performance for most applications | |
| CO2 | Low energy performance for HVAC applications (...until us) | |

*GWP = global warming potential. The GWP of CO2 is one. Bigger is worse.

FIG. 1

Prior Art

Table 800

| Cooling Mode COP Comparison* | | | | |
|---|---|---|---|---|
| Refrigeration Cycle Type | Reference Environment Reject Temperature | | | |
| | 50° C | 40° C | 30° C | 20° C |
| **Transcritical $CO_2$ Cooling Cycle with Isochoric Heating** | **3.7** | **4.5** | **5.0** | **5.4** |
| Transcritical $CO_2$ Cooling Cycle | <1.5 | <2 | 2.2 | 2.9 |
| State of the Art Standard Heat Pumps | <4 | ~4 | ~5 | >5 |
| *COP or Coefficient of Performance = heat moved divided by work (electricity) put into the system. Higher is better. Heating mode COP = cooling mode COP + 1 | | | | |

Column 802

FIG. 8

SYSTEMS AND METHODS OF HEATING AND COOLING CYCLE WITH ISOCHORIC HEATING

CROSS-REFERENCE TO RELATED APPLICATIONS

The present application claims the benefit of U.S. Provisional Patent Application No. 63/432,527 filed Dec. 14, 2022, and entitled "Transcritical Refrigeration Cycle with Isochoric Heating" which is incorporated by reference herein.

FIELD OF THE INVENTION

Embodiments of the present invention(s) related generally to systems and methods of heating and cooling using isochoric heating.

BACKGROUND

Heating and cooling systems are used to provide a climate-controlled environment in various applications such as space heating and cooling, domestic hot water system, pool heating, refrigeration, process water heating, heat recovery, and more. Space heating, space cooling, and water heating account for some of the largest energy expenses in any home or business. Beyond temperature control, heating, and cooling systems are also a part of freezing and cryogenic operations of food and beverages including applications of flash-freezing food for the purposes of storing perishable food items. There are many industrial applications to heating and cooling, including the steps of electrode coating, drying and curing of electrode materials, and battery assembly in battery manufacturing. For example, battery drying may account for one quarter of the overall energy consumption of manufacturing a battery. Maintaining temperature control is an important part of battery manufacturing, and accounts for a major part of the heating and cooling requirements.

Typical modern refrigeration methods utilize synthetic refrigerants; however, these refrigerants pose a serious threat to the planet, due to their Global Warming Potential (GWP)—a measure of the energy absorbed from the emission of a gas over a specific period of time, relative to that of carbon dioxide. FIG. 1 is a table depicting different refrigerants that are used in cooling systems. By definition, the GWP of carbon dioxide is one. If a gas's GWP is higher than one, it will warm the planet more than the same amount of carbon dioxide, if released. Commonly used refrigerants, such as those based on Chlorofluorocarbons (CFCs), hydrofluorocarbons (HFCs), and hydrochlorofluorocarbons (HCFCs), have GWP's thousands of times higher than that of carbon dioxide. These refrigerants frequently leak or are otherwise released into the atmosphere, and therefore contribute to global warming.

SUMMARY

An example method of a cooling cycle comprises compressing a refrigerant at a first state to a second state, the first state being at a first temperature and a first pressure, the second state being at a second temperature and a second pressure, the second temperature being higher than the first temperature, the refrigerant at the initial state being at a particular bulk density, cooling the refrigerant at the second temperature and the second pressure to a third temperature, the second temperature being less than the third temperature, the cooling of the refrigerant being at a constant pressure, expanding the refrigerant at the third temperature and the second pressure to a fourth temperature, the fourth temperature being less than the third temperature, the fourth temperature corresponding to a third state where the refrigerant is at the particular bulk density, and heating the refrigerant at the fourth temperature to the first temperature at the particular bulk density that is constant from the third state to the first state.

The cooling cycle may be a transcritical cooling cycle. In some embodiments, the method may further comprise recovering energy when expanding the refrigerant at the third temperature and the second pressure to the fourth temperature.

During heating of the refrigerant at the fourth temperature to the first temperature at the particular bulk density, heat may be transferred at a constant volume, vaporizing and pre-compressing the refrigerant. In some embodiments, expanding the refrigerant at the third temperature and the second pressure to the fourth temperature is isentropic expansion.

In various embodiments, heating the refrigerant at the fourth temperature to the first temperature at the particular bulk density is isochoric heating. Compressing the refrigerant at the first state to the second state may comprise isentropic compression, and cooling the refrigerant at the second temperature and the second pressure to the third temperature may comprise isobaric cooling.

In some embodiments, the refrigerant does not undergo a phase change when cooling the refrigerant at the second temperature and the second pressure to the third temperature.

The refrigerant in some examples, may be carbon dioxide, air, or propane.

An example system comprises an apparatus configured to compress a refrigerant at a first state to a second state, the first state being at a first temperature and a first pressure, the second state being at a second temperature and a second pressure, the second temperature being higher than the first temperature, the refrigerant at the initial state being at a particular bulk density, cool the refrigerant at the second temperature and the second pressure to a third temperature, the second temperature being less than the third temperature, the cooling of the refrigerant being at a constant pressure, expand the refrigerant at the third temperature and the second pressure to a fourth temperature, the fourth temperature being less than the third temperature, the fourth temperature corresponding to a third state where the refrigerant is at the particular bulk density, and heat the refrigerant at the fourth temperature to the first temperature at the particular bulk density that is constant from the third state to the first state.

Compressing, cooling, expanding, and heating the refrigerant may be at least part of a transcritical cooling cycle. In some embodiments, the apparatus further comprises an expander to recover energy when expanding the refrigerant at the third temperature and the second pressure to the fourth temperature.

The apparatus may be configured to transfer heat at a constant volume while vaporizing and pre-compressing the refrigerant to the first temperature at the particular bulk density. In some embodiments, the apparatus is configured to perform isentropic expansion when expanding the refrigerant at the third temperature and the second pressure to the fourth temperature.

In various embodiments, the apparatus is configured to perform isochoric heating when heating the refrigerant at the fourth temperature to the first temperature at the particular bulk density. The apparatus may be configured to perform isentropic compression when compressing the refrigerant at the first state to the second state, and perform isobaric cooling when cooling the refrigerant at the second temperature and the second pressure to the third temperature.

In some embodiments, the refrigerant does not undergo a phase change when cooling the refrigerant at the second temperature and the second pressure to the third temperature.

The refrigerant may, in some examples, be carbon dioxide, air, or propane.

Another example method of a cooling cycle comprises compressing a refrigerant at a first state to a second state, the first state being at a first temperature and a first pressure, the second state being at a second temperature and a second pressure, the second temperature being higher than the first temperature, the refrigerant at the initial state being at a first density, cooling the refrigerant at the second temperature and the second pressure to a third temperature, the second temperature being less than the third temperature, the cooling of the refrigerant being at a constant pressure, expanding the refrigerant at the third temperature and the second pressure to a fourth temperature, the fourth temperature being less than the third temperature, the fourth temperature corresponding to a third state where the refrigerant is at the particular bulk density, heating the refrigerant at the fourth temperature to a fifth temperature at a particular bulk density that is constant from the third state to a fourth state using isochoric heating; and heating the refrigerant from the fourth state to the first state using isobaric vaporization.

BRIEF DESCRIPTION OF THE DRAWINGS

FIG. 1 is a table depicting different refrigerants that are used in cooling systems.

FIG. 8 is a table depicting a Coefficient of Performance (COP) comparison of different cooling systems.

DETAILED DESCRIPTION

Figure 2:
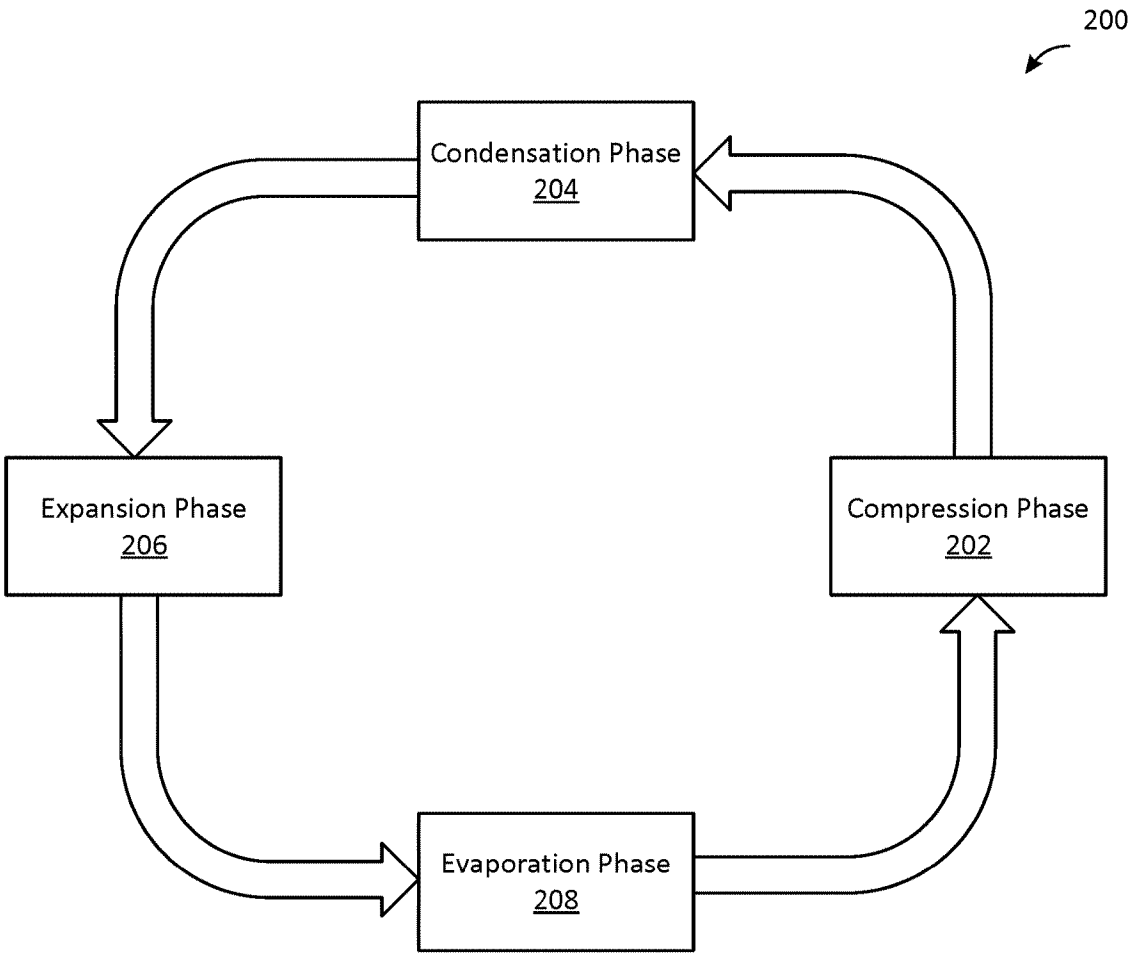
FIG. 2 is a block diagram of a heating or cooling system according to some embodiments.

In response to the global warming threat posed by high-GWP refrigerants, researchers and industry have been searching for alternative refrigerants and methods of refrigeration; sustainable solutions to replace legacy, harmful chemicals. Within the search for alternative refrigerants, there are two main classes: 1) new synthetic refrigerants, and 2) natural refrigerants.

HCFCs, or R-22, as previously mentioned, have the disadvantage of having a high GWP, and have been widely used in heating and cooling systems for many years. However, their popularity has been greatly reduced in the last several decades due to their ozone depletion properties.

HFC or R-134a was a popular replacement for CFCs and HCFCs. HFC has zero ozone depletion potential. However, HFC has a disadvantage in that it has a GWP of 1430 and if overheated, HFC produces toxic by-products.

New synthetic refrigerants are typically designed to be a direct replacement for legacy refrigerants, to be used in existing system designs and equipment. For example, R-1234yf (2,3,3,3-tetrafluoropropene), a hydrofluoroolefin (HFO), is being used in air conditioning systems in new vehicles to replace R-134a (1,1,1,2-tetrafluoroethane), an HFC. The new synthetic refrigerant, R-1234yf has a GWP less than one, while R-134a has a GWP of 1,430. At first glance, the GWP difference between the two looks like an improvement; however, R-1234yf can break down into trifluoroacetic acid, a strong acid, toxic to aquatic organisms, even at low concentrations—a trade between global warming and water pollution is not much of a step forward in sustainability.

Other new refrigerants have similar problems. For example, R-1234ze (1,3,3,3-tetrafluoropropene), also a replacement for R-134a, decomposes to fluoroform in the atmosphere, which has a GWP of 14,800. In this case, the negative effects of the refrigerant are partially mitigated if the initial compound is never released, but when it is released, intentionally or otherwise, the global warming effect is somewhat delayed while it decays, but the damage it causes when it finally does decay is worse than that of the refrigerant it was intended to replace.

Another approach is to seek existing synthetic refrigerants with lower GWP. For example, R-32 (difluoromethane), which is itself a legacy refrigerant, is being reintroduced as an alternative refrigerant because its GWP of 675 is smaller than other standard synthetic refrigerants; however, it is flammable—which is partially why it was initially phased out—and in the atmosphere, it breaks down into carbonyl fluoride, which is highly toxic.

Propane, R-290 is another alternative synthetic refrigerant with a GWP of 3, making it an environmentally friendly option for heating and cooling. This refrigerant has an efficient heat transfer resulting in an energy efficient cooling cycle. Propane is readily available and has a zero-ozone depletion potential. However, propane is a highly flammable gas, which presents safety concerns which makes it difficult to use for large industrial heating and cooling applications.

Synthetic refrigerants typically do not perform as well as the refrigerant they are to replace. To date, an ideal, direct replacement for legacy refrigerants does not exist. Gains in developing or finding a suitable alternative are marginal, if at all—presenting a serious problem for the refrigeration industry. Because of this dilemma, researchers have also been exploring natural refrigerants.

The most common natural refrigerants are ammonia, naturally occurring hydrocarbons, water, air, and carbon dioxide. Some, like ammonia, were widely used in the early history of refrigeration. Natural refrigerants usually have low GWP, compared to most synthetic refrigerants; however, natural refrigerants present their own challenges. Ammonia can be toxic. Hydrocarbons are highly flammable.

Water is a poor refrigerant; though, it can be used in evaporative cooling, but only in dry climates with moderate cooling needs.

Carbon dioxide has been on the cusp of wider utilization as a refrigerant for several years, but in common heating and cooling applications, carbon dioxide-based systems are less efficient than vapor compression systems using standard, synthetic refrigerants. A key challenge to carbon dioxide's widespread use as a refrigerant is that it is a poor working fluid in vapor compression refrigeration cycles for most heating, ventilation, and air conditioning (HVAC) applications.

In various embodiments described herein, a heat pump uses an inert, natural refrigerant that matches or exceeds the energy efficiency of synthetic refrigerants. While heat pumps may be described herein, it will be appreciated that systems and methods described herein may apply to any cooling and/or heating device(s). In one example, an efficient transcritical refrigerant cycle is used. FIG. 2 is a block diagram of a heating or cooling system 200 according to some embodiments. Note that heating and cooling systems utilize the same components, however, the order of the steps, or process is reversed. While a cooling cycle is used for cooling and air conditioning, a heating cycle is used for heating. In some embodiments, the heating or cooling system 200 is a cooling system. it can be appreciated that the system disclosed in FIG. 2 is a heating system.

The heating or cooling system 200 includes an evaporation phase 208, a compression phase 202, a condensation phase 204, and an expansion phase 206. It can be appreciated that the heating or cooling system 200 is a closed system, in that the refrigerant, such as the refrigerants listed in the table shown in FIG. 2, does not leave the components of the system. In some embodiments, only heat can be exchanged freely.

In one example, the heating or cooling system 200 is a cooling system. The evaporation phase 208 may occur or be performed by an evaporator component or apparatus. In a cooling system, the evaporator may be the part or space of the system which provides the cooling. For example, if the cooling system is part of the refrigerator, the evaporator may be part of the refrigerator that provides cooling to the area of the refrigerator where the food and beverages are kept.

During the evaporation phase 208, the refrigerant, such as carbon dioxide, may be in liquid form. The low-pressure, low-temperature refrigerant enters the evaporator and absorbs heat. In the process of absorbing the heat, the low-pressure, low-temperature refrigerant vaporizes to become a low-pressure vapor.

The compression phase 202 may occur or be performed by a compressor component or apparatus. The compressor is a central part of the cooling or refrigeration cycle. The compressor takes the low-pressure, low-temperature carbon dioxide vapor and compresses it to a high-pressure, high-temperature state. An energy input is required to compress the refrigerant, the compressor may include an electric motor.

Different types of compressor components may be utilized in a cooling cycle or a heating cycle. For example, compression phase 202 may be performed by a reciprocating compressor, centrifugal compressor, scroll compressor, or rotary compressor.

In one example, reciprocating compressors utilize a piston-cylinder apparatus. A piston placed inside a cylinder moves back and forth creating a suction stroke and a compression stroke. During the suction stroke, the piston moves downward, creating an area of low-pressure inside the cylinder, allowing the refrigerant gas to move into the area of the cylinder. During the compression stroke, the piston moves upward, compressing the refrigerant gas and increasing the pressure and temperature of the refrigerant gas.

Centrifugal compressors compress pressure, low-temperature refrigerant to a high-pressure, high-temperature by utilizing a rotating impeller. As the impeller rotates, refrigerant gas is drawn through the center of the impeller and is thrown outward from the center of the impeller toward walls of the compressed at a high velocity. The high velocity refrigerant gas encounters a diffuser, a stationary component of the centrifugal compressor that decelerates the high-velocity refrigerant, converting its kinetic energy into pressure and compressing the refrigerant gas.

Scroll compressors use two interlaced spiral metal pieces or scrolls to compress the refrigerant. One scroll is fixed in position while the other orbits. The orbiting scroll moves in a circular motion causing it to circle the stationary scroll. As the orbiting scroll moves, it traps and compresses the refrigerant between the space between the two scrolls, gradually reducing the volume and increasing the pressure.

Rotary compressors utilize a rotating mechanism such as a vane or blade to compress the refrigerant gas. As the vane or blade rotates, refrigerant gas is drawn into the compression chamber and compresses it.

The condensation phase 204 may occur or be performed by a condenser coil or a condenser apparatus. The high-pressure, high-temperature refrigerant flows to the condenser coil. The refrigerant releases heat to the surroundings and undergoes a phase change from gas to a high-pressure liquid. For example, if the cooling system is part of the refrigerator, the condenser coils dissipate the heat from the refrigerant into the surrounding air. The temperature of the refrigerant lowered over the course of the condensation phase 204. The temperature of the refrigerant is further lowered in the expansion phase 206.

The expansion phase 206 may occur or be performed by an expansion valve or throttling device. During the expansion phase 206, the temperature and pressure of the refrigerant go from a high-pressure liquid to a low-pressure, low-temperature. The low-pressure, low-temperature refrigerant may be in a mixture of liquid and vapor state. As the refrigerant expands, its temperature drops, this decrease in temperature is necessary to absorb heat from the surrounding environment in the evaporation phase 208, and the phases repeat.

Figure 3A:
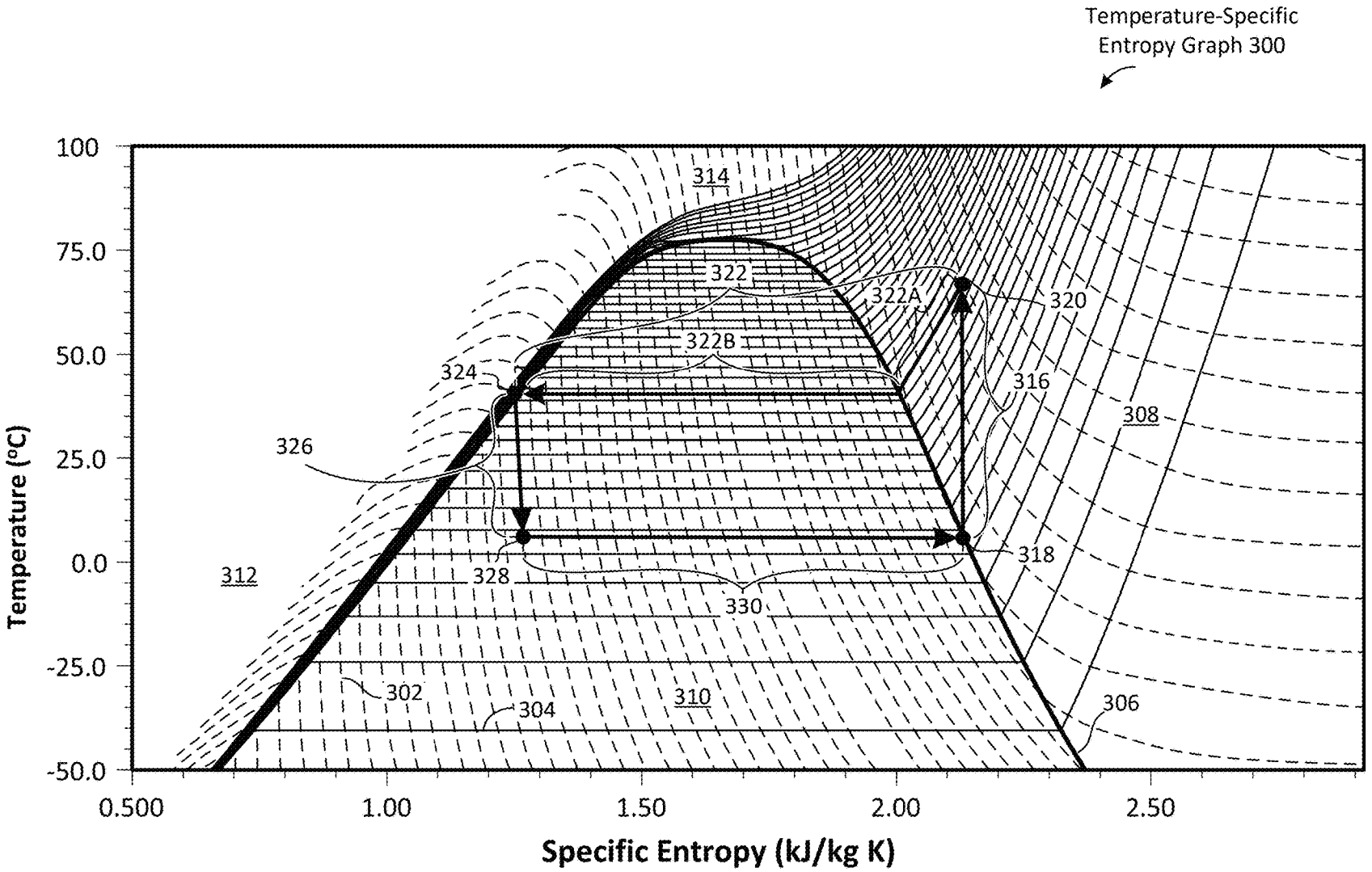
FIG. 3A Prior Art
FIG. 3A is a temperature-specific entropy diagram for a typical vapor compression refrigeration cycle.

FIG. 3A is a temperature-specific entropy graph 300 for a typical vapor compression refrigeration cycle. The temperature-specific entropy graph 300 plots temperature on the horizontal axis and specific entropy on the vertical axis. The illustrated graph shown in FIG. 3A represents a typical vapor compression refrigeration cycle in which the refrigerant is R-32. It can be appreciated that the temperature-entropy graph may have different constant enthalpy lines, constant pressure lines, and liquid-vapor saturation lines when a different refrigerant is used for the cooling or heating cycle. The temperature-specific entropy graph 300 includes constant enthalpy line 302, constant pressure line 304, and a liquid-vapor saturation line 306.

A typical vapor compression refrigeration cycle may include components such as an evaporator, a compressor, condenser coils, and an expansion valve or throttle valve. A refrigerant is circulated through the components of the typical vapor compression refrigeration cycle through a closed loop, where it undergoes a series of phase changes and heat transfers. The typical vapor compression refrigeration cycle includes an evaporator, a compressor, a condenser coil, and an expansion valve or throttle valve.

In some embodiments, the refrigerant is in a gaseous state when it has a temperature entropy corresponding to a point of the temperature-specific entropy graph 300 in a gas region 308. The refrigerant is in a two-phase liquid and vapor state when it has a temperature entropy corresponding to a point of the temperature-specific entropy graph 300 in a liquid-vapor region 310. The refrigerant is in a liquid state when it has a temperature entropy corresponding to a point of the temperature-specific entropy graph 300 in a liquid region 312. The refrigerant is in a supercritical fluid state when it has a temperature entropy corresponding to a point of the temperature-specific entropy graph 300 in a supercritical region 314.

A compression phase 316 may occur or be performed by a compressor component or apparatus. The compression phase 316 depicted in the temperature-specific entropy graph 300 represents a state change of the refrigerant from the state 318 to a state 320. During the compression phase 316, the compressor takes the low-pressure, low-temperature refrigerant such as R-32 vapor is compressed to a high-pressure, high-temperature state. In some embodiments, the compression phase 316 is an isentropic compression.

During isentropic compression (e.g., compression phase 316), the refrigerant does not undergo a phase change, the pressure and temperature of the refrigerant increase, while experiencing constant, or substantially constant entropy, as depicted by a vertical, or substantially vertical line of the temperature-specific entropy graph 300. Energy is consumed by the compressor component or apparatus to raise the temperature of the refrigerant in compressing the refrigerant. In this example, at or near the beginning of the compression phase 316, or the state 318, the refrigerant may have a temperature of 6° C. and a specific entropy of 2.15 KJ/kg K. At or near the end of the compression phase 316 in this example, or the state 320, the refrigerant may have a temperature of 65° C. and a specific entropy of 2.15 KJ/kg K.

A condensation phase 322 (e.g., isobaric condensation) may occur or be performed by a condenser coil or a condenser apparatus. In this phase, heat is transferred away from the cycle at constant pressure and temperature, thereby condensing the refrigerant. The condensation phase 322 depicted in the temperature-specific entropy graph 300 represents a state change of the refrigerant from the state 320 to a state 324. During condensation phase 322, high-pressure, high-temperature refrigerant, in a gaseous state, enters the condenser coil. The refrigerant releases heat to the surroundings and undergoes a phase change from a gas to a high-pressure liquid. In some embodiments, the condensation phase 322 is an isobaric condensation.

During the isobaric condensation, the temperature of the refrigerant decreases until it reaches a saturation temperature at which the vapor phase transitions to a liquid phase. This decrease in temperature is represented by section 322A of the condensation phase 322. The decrease in temperature causes heat to be released to the surrounding environment. The phase change from gas to liquid that takes place during section 322B of the condensation phase 322 occurs while the pressure of the refrigerant stays constant or substantially constant. In this example, at or near the beginning of the condensation phase 322, the refrigerant may have a temperature of 65° C. and a specific entropy of 2.15 KJ/kg-K. At or near the end of the condensation phase 322 in this example, at the state 324, the refrigerant may have a temperature of 40° C. and a specific entropy of 1.25 KJ/kg K.

In the expansion phase 326 (e.g., isenthalpic expansion phase), the refrigerant temperature is lowered by reducing its pressure at constant enthalpy. The expansion phase 326 may occur or be performed by an expansion valve or throttling device. The expansion phase 326 depicted in the temperature-specific entropy graph 300 represents a state change from the state 324 to the state 328. During the expansion phase 326, the high-pressure liquid experiences a phase state change from to a mixture of liquid and vapor. The temperature and pressure of the refrigerant may also change from high-pressure, high-temperature to low-pressure, low temperature. As the refrigerant expands, its temperature drops, this decrease in temperature is necessary to absorb heat from the surrounding environment in the evaporation phase 208.

In some embodiments, the expansion phase 326 is an isenthalpic expansion phase. During isenthalpic expansion, the phase state, as well as the temperature and pressure, of the refrigerant changes from liquid to a mixture of liquid and gas. The refrigerant temperature is lowered by reducing its temperature at a constant or substantially constant enthalpy, as seen in temperature-specific entropy graph 300. Energy is lost through the expansion valve due to the irreversibility of the expansion process. As the refrigerant passes through the expansion valve or device, it encounters resistance which leads to energy loss. Furthermore, there may be heat transfer between the refrigerant and that surrounding environment. The line on the temperature-specific entropy graph 300 representing expansion phase 326 may be parallel to a constant enthalpy line 302.

For points along a particular constant enthalpy line 302, the enthalpy value does not change. Any changes in pressure, temperature, or other properties of the refrigerant are compensated for by changes in volume. Heat absorption or heat transfer along a particular constant enthalpy line 302 allows for an effective cooling or heating process compared to heat absorption or heat transfer which occurs between more than one constant enthalpy line.

An evaporation phase 330 (e.g., isobaric vaporization) may occur or be performed by an evaporator component or apparatus. The evaporation phase 330 depicted in the temperature-specific entropy graph 300 represents a state change of the refrigerant from a state 328 to a state 318. During the evaporation phase 330, the evaporator takes the low-pressure, low-temperature refrigerant and is vaporized to become a low-pressure vapor. In one example, at the state 318, the refrigerant may exist as both a liquid and a vapor. The liquid-vapor saturation line 306 is a boundary between a liquid phase and a gas phase of the refrigerant. At any point on the liquid-vapor saturation line 306, the refrigerant exists simultaneously as both a liquid and a vapor.

In some embodiments, the evaporation phase 330 is an isobaric vaporization. During isobaric vaporization, the refrigerant changes from a liquid phase to a gas phase while experiencing a constant pressure, as depicted by a horizontal, or substantially horizontal line on the temperature-specific entropy graph 300. In one example, the state 328 may have a temperature of 6° C. and a specific entropy of 1.28 KJ/kg K (kilojoule/kilogram Kelvin). In this example, at state 318, the refrigerant, R-32, may have a temperature of 6° C. and a specific entropy of 2.15 KJ/kg K.

For points along a particular constant pressure line 304, the pressure of the substance, in the case of the temperature-specific entropy graph 300, which is refrigerant R-32, does not change as the temperature and/or volume of the refrigerant changes. Condensation or vaporization that occurs along a particular constant pressure line 304 are more efficient compared to condensation or vaporization which occurs along more than one constant pressure line.

It can be appreciated that the vapor compression heating cycle is the reverse of the vapor compression refrigeration cycle. The order of the phases of the cooling system 200 may be reversed for a heating system.

Figure 3B:
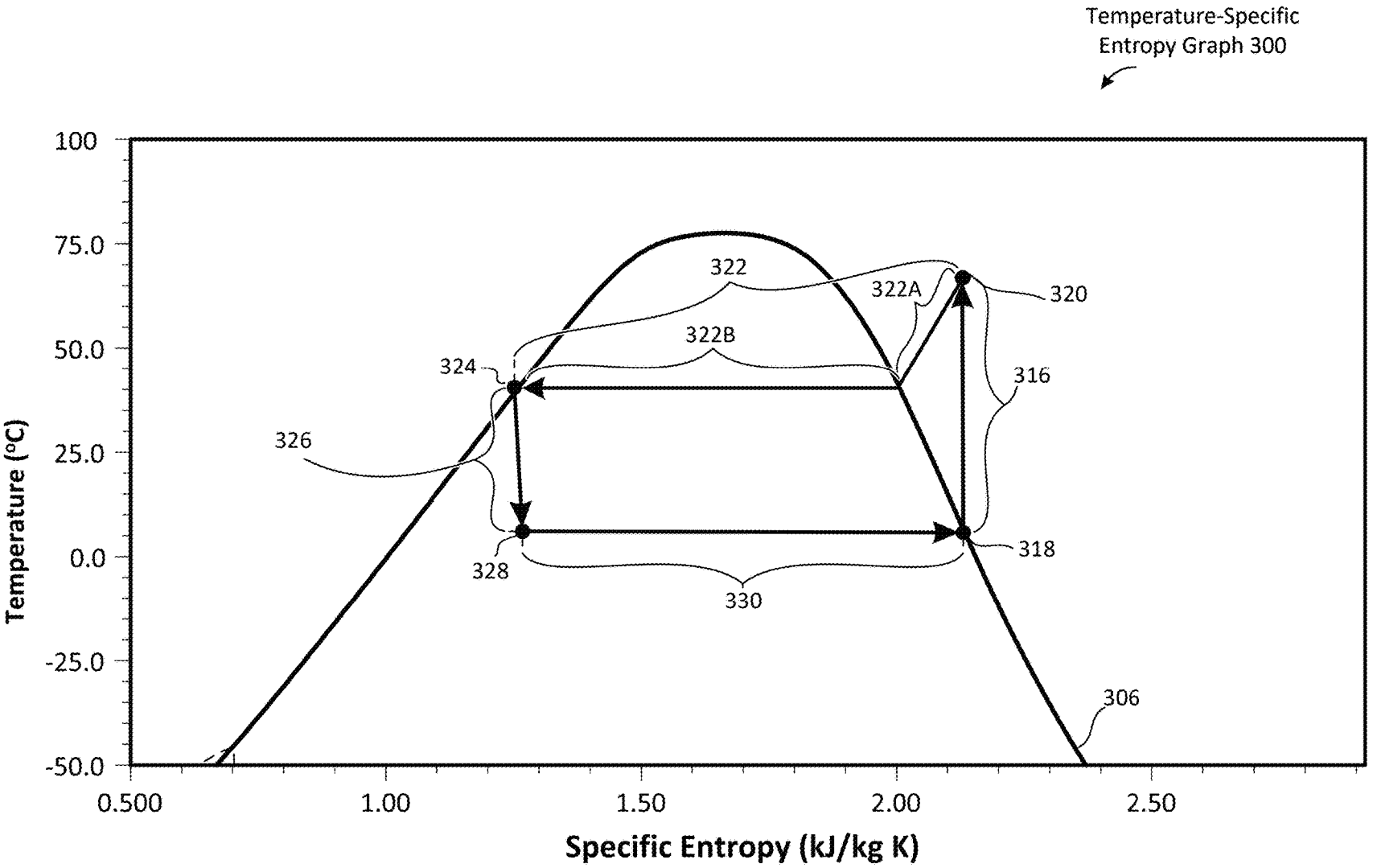
FIG. 3B Prior Art
FIG. 3B is the same temperature-specific entropy diagram as FIG. 3A showing the different phases of the typical vapor compression refrigeration cycle.

FIG. 3B shows the same temperature-specific entropy diagram as FIG. 3A, but without the constant pressure lines and constant enthalpy lines for further clarity. The phases of the typical vapor compression refrigeration cycle can be more easily seen in FIG. 3B including, for example, phase 316 which may include isentropic compression, phase 322 (including phases 322A and 322B which may include isobaric condensation, phase 326 which may include isenthalpic expansion, and phase 330 which may include isobaric vaporization. FIGS. 3A and 3B may depict, for example, a cycle in cooling mode on a hot day. In this example, all cycles may be under the same operating conditions.

Figure 4:
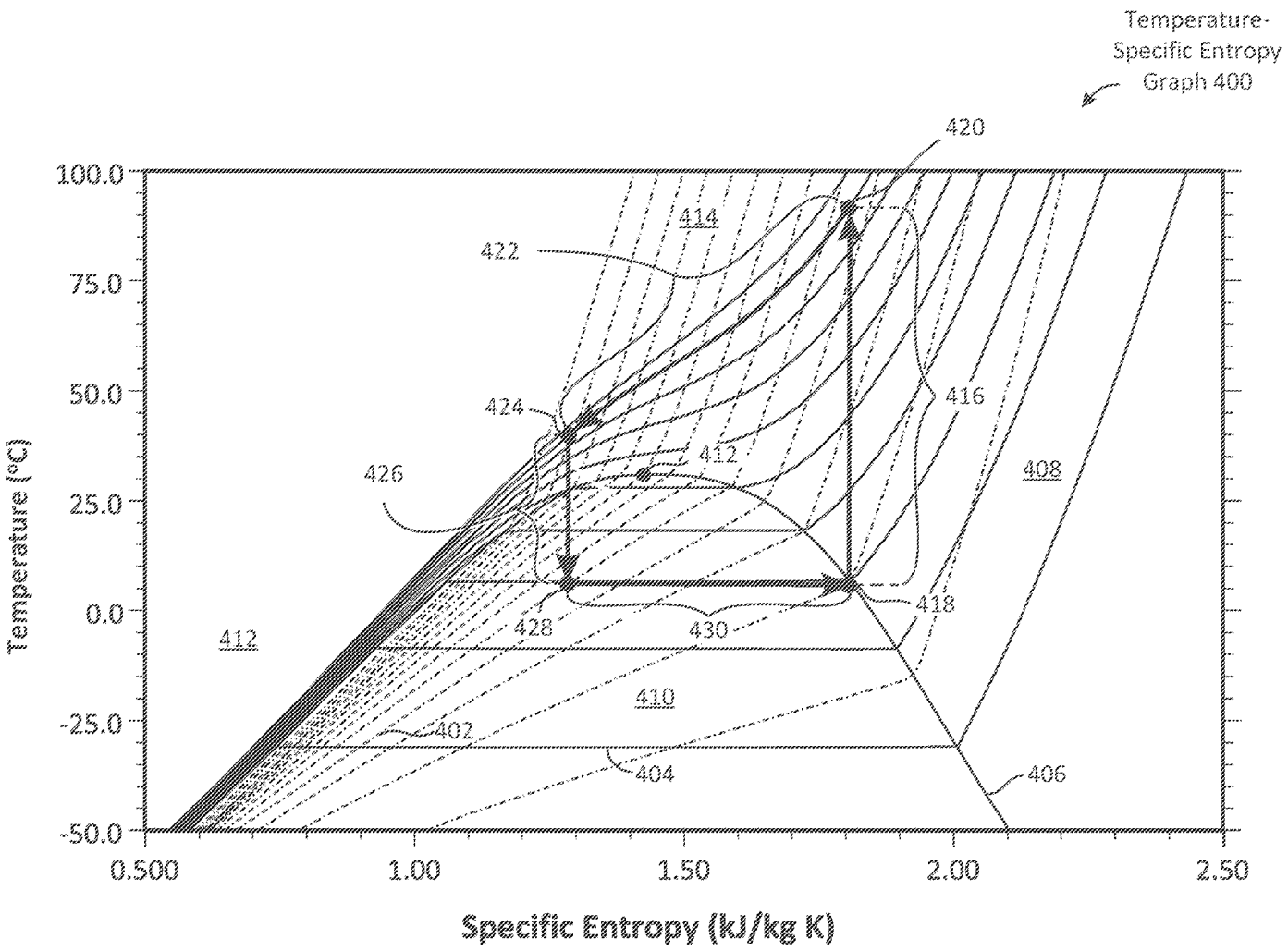
FIG. 4 is a temperature-specific entropy diagram for a transcritical cooling cycle which utilizes carbon dioxide according to some embodiments.

FIG. 4 is a temperature-specific entropy diagram for a transcritical cooling cycle which utilizes carbon dioxide ($CO_2$) according to some embodiments. In a transcritical cooling cycle, the refrigerant may exist in a supercritical state. When a refrigerant exists in a supercritical state, it exists neither as a distinct liquid nor a distinct vapor but exhibits properties of both states. Transcritical cycles are generally associated with cooling cycles, while typical vapor compression cycles may include cooling cycles or heating cycles.

The illustrated graph shown in FIG. 4 represents a transcritical carbon dioxide ($CO_2$) cooling cycle. $CO_2$ is a commonly used refrigerant in transcritical cooling cycles, however, it is possible to have a transcritical cycle with other refrigerants including ammonia, R-134a, air, and a carbon dioxide-ammonia mixture. It can be appreciated that the temperature-entropy graph may have different constant volume lines, constant pressure lines, and liquid-vapor saturation lines when a different refrigerant is used for the cooling cycle. The temperature-specific entropy graph 400 includes constant volume line 402, constant pressure line 404, and a liquid-vapor saturation line 406.

The component of the transcritical $CO_2$ cooling cycle as represented by the temperature-specific entropy graph 400 may be similar to that of the typical vapor compression refrigeration cycle, however, components of the transcritical $CO_2$ cooling cycle may include a gas cooler which may be used in the condensation phase.

In some embodiments, the refrigerant is in a gaseous state when it has a temperature entropy corresponding to a point of the temperature-specific entropy graph 400 in a gas region 408. The refrigerant is in a two-phase liquid and vapor state when it has a temperature-entropy corresponding to a point of the temperature-specific entropy graph 400 in a liquid and vapor liquid-vapor region 410. The refrigerant is at a supercritical point when it has a temperature-entropy corresponding to a point of the temperature-specific entropy graph 400 in a liquid region 412. For example, the critical temperature of $CO_2$ is 31° C. The refrigerant is in a supercritical fluid state when it has a temperature entropy corresponding to a point of the temperature-specific entropy graph 400 in a supercritical region 414.

A compression phase 416 (e.g., isentropic compression) may occur or be performed by a compressor component or apparatus. The compression phase 416 depicted in the temperature-specific entropy graph 400 represents a state change of the refrigerant from the state 418 to a state 420. During compression phase 416, the compressor takes the low-pressure, low-temperature refrigerant such as $CO_2$ vapor to compress to a high-pressure, high-temperature state. In some embodiments, the compression phase 416 is an isentropic compression process.

During the isentropic compression process, the refrigerant does not undergo a phase change, the pressure and temperature of the refrigerant increase, while experiencing constant, or substantially constant entropy, as depicted by a vertical, or substantially vertical line of the temperature-specific entropy graph 400. Energy is consumed in order to compress the refrigerant which causes the temperature of the refrigerant to increase. In this example, at or near the beginning of the compression phase 416, or the state 418, the refrigerant may have a temperature of 5° C. and a specific entropy of 1.8 KJ/kg K. Further in this example, at or near the end of the compression phase 416, or the state 420, the refrigerant may have a temperature of 92° C. and an specific entropy of 1.8 KJ/kg K.

A condensation phase 422 (e.g., isobaric cooling) may occur or be performed by a condenser coil or a condenser apparatus. The condensation phase 422 depicted in the temperature-specific entropy graph 400 represents a state change of the refrigerant from the 420 to a state 424. During the condensation phase 422, high-pressure, high-temperature refrigerant, in a supercritical state, flows into a condenser coil or condenser apparatus. Heat from the refrigerant is transferred to the surroundings. In some embodiments, the condensation phase 422 is an isobaric cooling process.

In an isobaric cooling process, the pressure within the cooling system remains constant or substantially constant, the volume of the refrigerant also decreases as the temperature decreases. The phase of the refrigerant does not change over the course of the isobaric cooling process. This is in contrast to the isobaric condensation which may take place during the condensation phase 322 of typical vapor compression refrigeration cycle, in which the refrigerant experiences a phase change from vapor to liquid over the course of the isobaric condensation process. An advantage of isobaric cooling allows for exact temperature control while maintaining constant pressure. Isobaric cooling may be more energy efficient compared to isobaric condensation as a decrease in temperature is needed, while a phase change is not required.

In the liquid-vapor region 410, constant pressure lines are horizontal, however, the regions outside the liquid-vapor region 410, such as the supercritical region 414, are sloped and converge in a region of the temperature-specific entropy graph 400 separating the two-phase liquid and vapor liquid-vapor region 410 and the liquid region 412. In one example, at or near the beginning of the condensation phase 422, or the state 420, the refrigerant may have a temperature of 92° C. and a specific entropy of 1.8 KJ/kg K. Further in this example, at or near the end of the condensation phase 422, or the state 424, the refrigerant may have a temperature of 40° C. and a specific entropy of 1.3 KJ/kg K.

An expansion phase 426 (e.g., isentropic expansion) may occur or be performed by an expansion valve or throttling device. The expansion phase 426 depicted in the temperature-specific entropy graph 300 represents a state change from the state 424 to the state 428. During the expansion phase 426, the high-pressure refrigerant experiences a phase change from a supercritical fluid state to a mixture of liquid and vapor. The temperature and pressure of the refrigerant may also change from high-pressure, high-temperature to low-pressure, low temperature. In some embodiments, the expansion phase 426 is an isentropic expansion.

In contrast to the expansion phase 326 of the typical vapor compression refrigeration cycle, in which the refrigerant expands during the expansion phase 326 without a change in enthalpy, in the isentropic expansion, the refrigerant expands during the expansion phase 426 without a change in entropy. Furthermore, an isentropic expansion is adiabatic and reversible.

In the typical vapor compression refrigeration cycle, the expansion phase, such as the expansion phase 326 takes place entirely in the liquid-vapor region 310 which may make pressure recovery not worthwhile. In transcritical $CO_2$ cycles, the expansion phase 426 may take place above the critical point, and as the refrigerant expands above the critical point, the supercritical fluid experiences a significant decrease in temperature. In some embodiments, the components of the transcritical $CO_2$ cooling cycle may include an expander which allows the transcritical $CO_2$ cooling cycle to recover some of the energy lost during the expansion phase 426. Instead of allowing the significant decrease in temperature, as mentioned above, to go to waste, the expander recovers a portion of the energy.

In this example, at or near the beginning of the expansion phase 426, the refrigerant may have a temperature of 40° C. and a specific entropy of 1.3 KJ/kg K. Further, in this example, at or near the end of the expansion phase 426, at the state 428, the refrigerant may have a temperature of 5° C. and a specific entropy of 1.3 KJ/kg K.

An evaporation phase 430 (e.g., isobaric vaporization) may occur or be performed by an evaporator component or apparatus. The evaporation phase 430 depicted in the temperature-specific entropy graph 400 represents a state change of the refrigerant from a state 428 to a state 418. During the evaporation phase 430, the evaporator takes the low-pressure, low-temperature refrigerant and is vaporized to become a low-pressure vapor. In one example, at the state 418, the refrigerant may exist as both a liquid and a vapor. The liquid-vapor saturation line 406 is a boundary between a liquid phase and a gas phase of the refrigerant. At any point on the liquid-vapor saturation line 406, the refrigerant exists simultaneously as both a liquid and a vapor.

In some embodiments, the evaporation phase 430 is an isobaric vaporization. During isobaric vaporization, the refrigerant changes from a liquid phase to a gas phase while experiencing a constant pressure, as depicted by a horizontal, or substantially horizontal line on the temperature-specific entropy graph 400. In one example, the state 428 may have a temperature of 5° C. and a specific entropy of 1.3 KJ/kg-K. In this example, at state 318, the refrigerant, R-32, may have a temperature of 5° C. and a specific entropy of 1.8 KJ/kg K.

Figure 5:
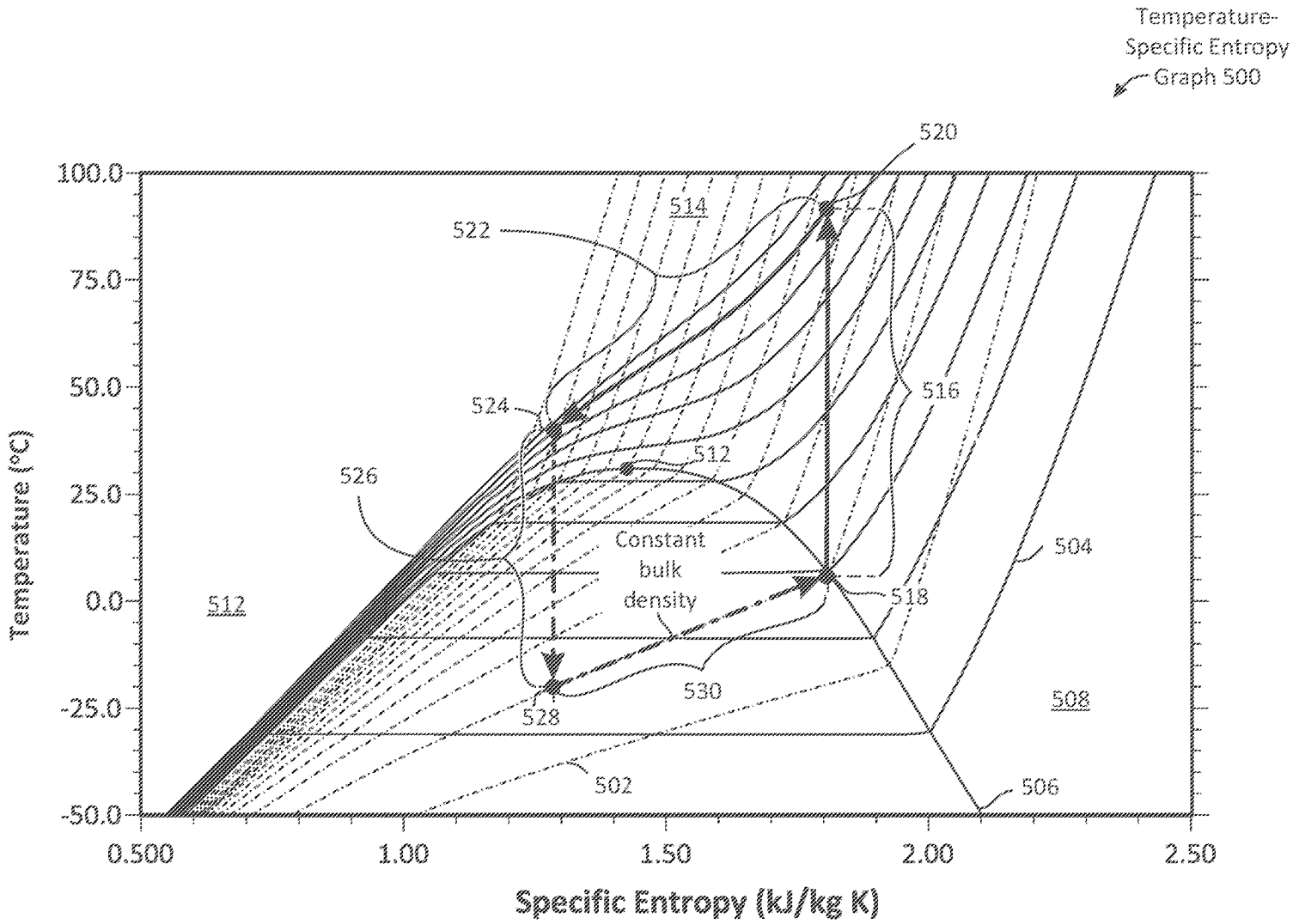
FIG. 5 is a temperature-specific entropy diagram of a cooling system which utilizes transcritical heating or cooling cycle with isochoric heating according to some embodiments.

FIG. 5 is a temperature-specific entropy diagram 500 of a heating or cooling system which utilizes transcritical cooling cycle with isochoric heating according to some embodiments. Similar to the transcritical cooling cycle of the temperature-specific entropy graph 400 seen in FIG. 4, the refrigerant exists in a supercritical state.

The illustrated graph shown in FIG. 5 represents a transcritical carbon dioxide ($CO_2$) cooling cycle. $CO_2$ is a commonly used refrigerant in transcritical cooling cycles, however, it is possible to have a transcritical cycle with other refrigerants such as ammonia, R-134a, air, and a carbon dioxide-ammonia mixture. By applying the phases of the transcritical cooling cycle as described in FIG. 5, the coefficient of performance of existing natural and synthetic refrigerant can be increased, thereby making existing natural and synthetic refrigerants more energy efficient and environmentally friendly. It can be appreciated that the illustrated graph of FIG. 5 represents the transcritical carbon dioxide ($CO_2$) cooling cycle for heating applications. The temperature-specific entropy graph 500 may be different, for example, the locations on the temperature-specific entropy graph 500 corresponding to the states 518, 520, 524, and 528 may be different depending on the cooling needs of the application. Although there may be differences, the differences and adjustments are clear based on the discussion of the cooling discussed with respect to FIG. 5 herein.

In some embodiments, the cooling cycle may be a subcritical cooling cycle or a subcritical heating cycle. It can be appreciated that the temperature-entropy graph may have different constant volume lines, constant pressure lines, and liquid-vapor saturation lines when a different refrigerant is used for the cooling cycle. The temperature-specific entropy graph 500 includes constant volume line 502, constant pressure line 504, and a liquid vapor saturation line 506.

One or more of the components of the transcritical $CO_2$ cooling cycle as represented by the temperature-specific entropy graph 500 may be similar to that of the components of the transcritical $CO_2$ cooling cycle as represented by the temperature-specific entropy graph 400. In some embodiments, components of the transcritical $CO_2$ cooling cycle as represented by the temperature-specific entropy graph 500 includes one or more components which facilitate pressure recovery of the refrigerant.

In some embodiments, the refrigerant is in a gaseous state when it has a temperature entropy corresponding to a point of the temperature-specific entropy graph 500 in a gas region 508. The refrigerant may be in a two-phase liquid and vapor state when it has a temperature entropy corresponding to a point of the temperature-specific entropy graph 500 in a liquid-vapor region 510. The refrigerant may be at a supercritical point when it has a temperature entropy corresponding to a point of the temperature-specific entropy graph 500 in a liquid region 512. The refrigerant may be in a supercritical fluid state when it has a temperature-entropy corresponding to a point of the temperature-specific entropy graph 500 in a supercritical region 514.

A compression phase 516 (e.g., isentropic compression) may occur or be performed by a compressor component or apparatus. In one example, the compression phase 516 includes a single-stage compression device or apparatus. In some embodiments, the compression phase 516 includes a multi-stage compression device or apparatus. The compression phase 516 depicted in the temperature-specific entropy graph 500 represents a state change of the refrigerant from the state 518 to a state 520. It can be appreciated that compression phase 516 may be similar to that of compression phase 416 of FIG. 4. In one example, the refrigerant undergoes a phase change from a mixture of liquid and vapor to a supercritical fluid.

A condensation phase 522 (e.g., isobaric cooling) may occur or be performed by a gas expander or gas expanding apparatus. The condensation phase 522 depicted in the temperature-specific entropy graph 300 represents a state change of the refrigerant from the state 520 to a state 524. It can be appreciated that the condensation phase 522 may be similar to that of condensation phase 422 of FIG. 4.

An expansion phase 526 (e.g., isentropic expansion) may occur or be performed by an apparatus which facilitates pressure recovery of the refrigerant (e.g., via an expander). This cycle may allow for more energy to be recovered than what may be possible in other transcritical cycles (e.g., as discussed in FIG. 4). This line may also be longer to allow for constant volume in the evaporation phase (as discussed herein) and allows for more energy to be potentially recovered.

In one example, the expansion phase 526 may occur or be performed by an expansion valve or throttling device. The expansion phase 526 depicted in the temperature-specific entropy graph 500 represents a state change from the state 524 to state 528. During the expansion phase 526, the high-pressure refrigerant experiences a phase change from a supercritical fluid state to a mixture of liquid and vapor. In some embodiments, the expansion phase 526 is an isentropic expansion process.

In some embodiments, in contrast to an isenthalpic expansion of expansion phase 326 of the typical vapor compression refrigeration cycle, in which the refrigerant expands without a change in enthalpy, in the isentropic expansion, the refrigerant expands during the expansion phase 426 without a change in entropy. Furthermore, an isentropic expansion is adiabatic, meaning that there is no heat transfer into or out of the cooling system. The isentropic expansion may also be reversible such that the process can be reversed without an increase in entropy. As previously mentioned, the expansion phase 526 takes place above the critical point of the refrigerant, and as the refrigerant expands, the supercritical fluid experiences a significant decrease in temperature. This significant decrease in temperature can be recovered by using an expander to recover a portion of the energy.

The expansion phase 526 of FIG. 5 includes a greater drop in temperature by introducing a greater decrease in pressure compared to the expansion phase 426 of FIG. 4. The expander may recover energy compared to the energy recovered by the expansion phase 426 of FIG. 4. This may make the cooling cycle of FIG. 5 more energy efficient compared to the cooling cycle of FIG. 4. In some embodiments, the resultant state of the expansion phase 526, or the state 528 may follow on the same constant volume line 502 as the state 518.

In an isochoric heating phase 530, heat is transferred into the cycle at constant volume, vaporizing and precompressing the refrigerant (e.g., $CO_2$). The isochoric heating phase 530 is an isochoric heating process. The isochoric heating phase 530 may vaporize refrigerants at a constant volume which further reduces work needed for compression. In this example, this is why the phase starts lower than the phase 430, yet still may arrive at the same final pressure.

In some embodiments, the isochoric heating phase 530 occurs or is performed by an arrangement of pistons and heat exchanges. The piston may permit heating while maintaining a constant or substantially constant volume and limits volume changes. The isochoric heating phase 530 depicted in the temperature-specific entropy graph 500 represents a state change of the refrigerant from the state 528 to the state 518. During the isochoric heating phase 530 the evaporator takes the low-pressure, low-temperature refrigerant is vaporized to become a low-pressure vapor.

In some embodiments, during isochoric heating, the refrigerant is heated at a constant volume, or the volume of the refrigerant is constant or substantially constant. The refrigerant absorbs heat, resulting in an increase in temperature. The refrigerant does not undergo a phase change during the isochoric heating phase 530. The pressure of the refrigerant may increase as the temperature increases. Isochoric processes in which a refrigerant is processed at a constant volume may be more energy efficient compared to isobaric processes in which a refrigerant is processed at a constant pressure since in constant volume processes, heat exchange is more energy efficient since additional energy is not required to overcome changes in volume.

Isochoric heat transfer for refrigeration has not been considered useful, historically, because the added complication, compared to isobaric heat transfer, is not immediately economical. Modern refrigeration cycles almost exclusively use isobaric condensation and vaporization because those methods can be used to build an energy efficient, reliable, and economical refrigeration cycle. Those cycles, however, work best when using what are to date, problematic refrigerants. Relative to isobaric stages found in standard vapor compression cycles, isochoric stages inevitably increase system and device complexity but allow a refrigeration cycle to be crafted that uses an inert, natural refrigerant without sacrificing efficiency.

In various embodiments, isochoric heating may be applied to the refrigerant until a certain point (e.g., a state between 528 and 518) between state 528 and state 518, after which heating the refrigerant from that point to state 518 is done using isobaric vaporization. In this example, isochoric heating of the refrigerant may be applied to the refrigerant at a constant bulk density until the point between state 528 and state 518 after which, isobaric vaporization may be utilized which may change the bulk density of the refrigerant to meet the density of state 518 where the cycle repeats.

Figure 6:
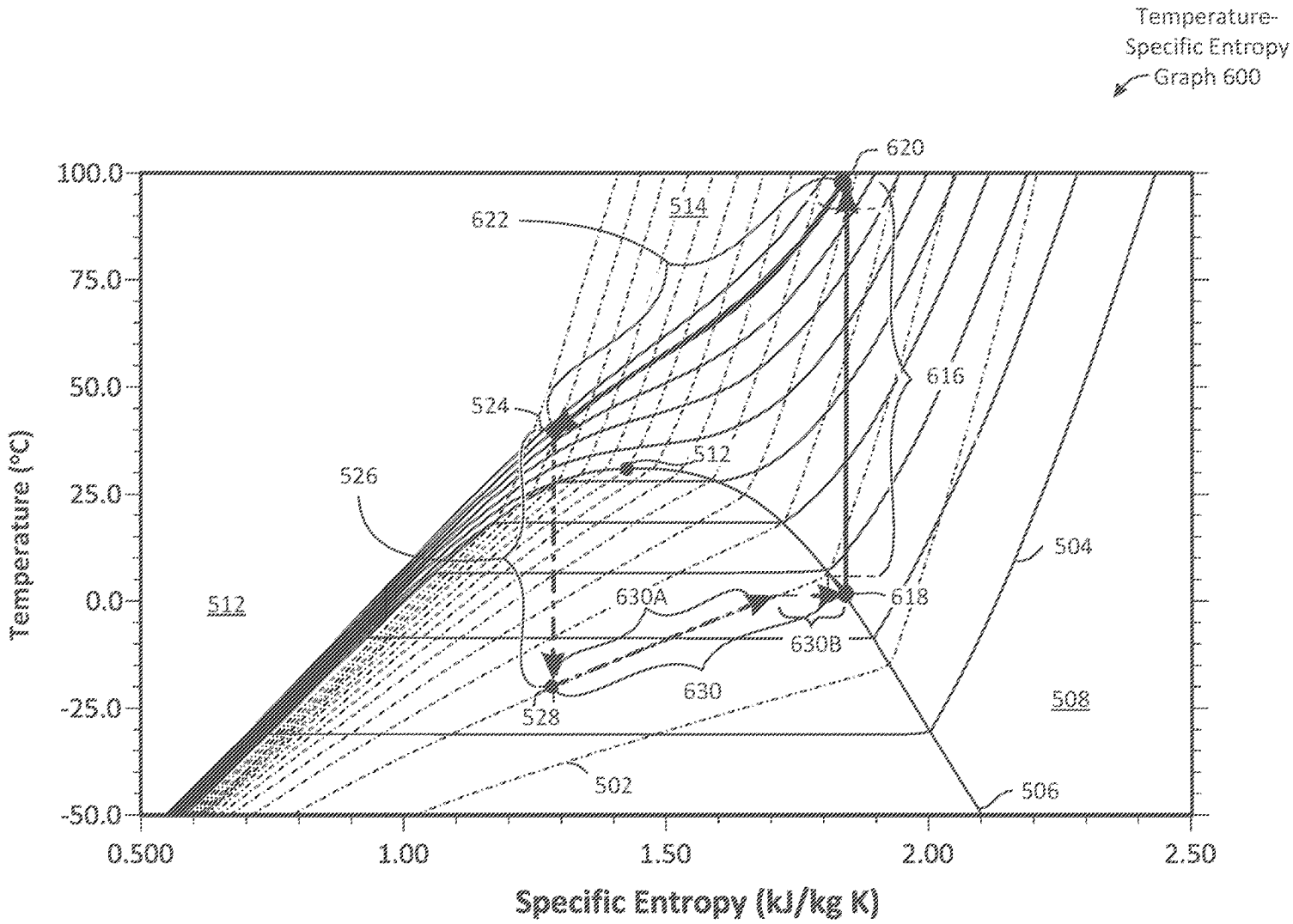
FIG. 6 is a temperature-specific entropy diagram of an example of a cooling system with an isochoric heating phase followed by an isobaric heating phase according to some embodiments.

FIG. 6 is a temperature-specific entropy diagram 600 of an example of a cooling system with an isochoric heating phase followed by an isobaric heating phase according to some embodiments. The temperature-specific entropy diagram 600 is similar to the temperature-specific entropy graph 500 of FIG. 5, such that elements which remain the same are given the same reference number as in FIG. 5.

The cooling system associated with the temperature-specific entropy diagram 600 includes compound cycles, specifically, the evaporation phase 630 is broken up into two processes, an isochoric heating process phase 630A and an isobaric vaporization process phase 630B. The isochoric heating process occurs up to a point, and then the isobaric vaporization process takes over. The result of this may move the location of a state 618, or the output of the evaporation phase 630 to another location along the liquid vapor saturation line 506. A comparison of a state 620 with the state 520 of FIG. 5 will determine that a compression phase 616 of FIG. 6 requires more energy to reach a particular constant pressure line 504, which also results in a condensation phase 622 that is different compared to the condensation phase 522 of FIG. 5.

Figure 7:
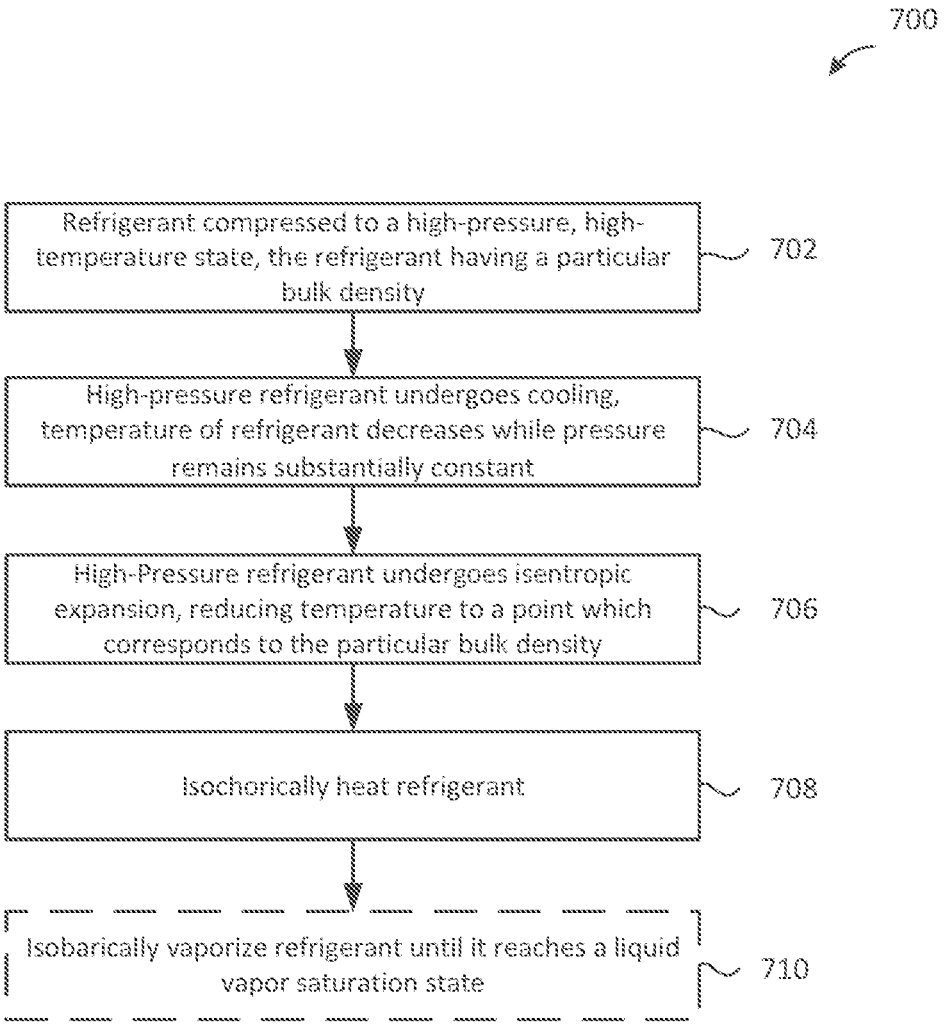
FIG. 7 is a flowchart showing a method of operating a cooling system with isochoric heating according to some embodiments.

FIG. 7 is a flowchart showing a method 700 of operating a cooling system with isochoric heating according to some embodiments. FIG. 7 describes a transcritical refrigeration cycle with a coefficient of performance that is improved and may be substantially consistent under a wide range of operating conditions, including hot climates. In some embodiments, the cycle utilizes an isochoric path for vaporization. In various embodiments and operating modes, the cycle utilizes work recovery during expansion to reduce the pressure of the working fluid. The cycle may additionally utilize phase change heat, thermal storage properties, or thermal properties of materials (e.g., unrelated to the refrigerant) to increase the overall utility and performance of the cycle.

In step 702, low-pressure, low-temperature refrigerant vapor is compressed to a high-pressure, high-temperature state. In some embodiments, a compressor component or apparatus performs compresses the refrigerant. In one example, the refrigerant undergoes a phase change from a mixture of liquid and vapor to a supercritical fluid. The refrigerant vapor has a particular bulk density.

In step 704, the high-pressure, high-temperature refrigerant undergoes cooling. The pressure of the refrigerant remains constant or substantially constant. In some embodiments, the volume of the refrigerant decreases as the temperature decreases. The refrigerant does not undergo a phase change over the course of the cooling and is still a supercritical fluid.

In step 706, the refrigerant is undergoing an isentropic expansion process. The isentropic expansion process reduces the temperature of the refrigerant to a point that corresponds to the particular bulk density. The pressure of refrigerant decreases as the temperature decreases. In some embodiments, the phase state of the refrigerant changes from a supercritical fluid to a mixture of liquid and vapor. In some embodiments, step 706 includes pressure recovery.

In step 708, heat or energy from the refrigerant is transferred at a constant volume or substantially constant volume. In some embodiments, the refrigerant undergoes an isochoric heating process. The refrigerant does not undergo a phase change over the course of the isochoric heating process. In some embodiments, the refrigerant is isochoric-ally heated until the phase state changes until it is a liquid vapor saturation line.

In optional step 710, the refrigerant is not isochoric-ally heated until the phase state changes until it is a liquid vapor saturation line. The isochoric heating process is followed by isobaric vaporization.

FIG. 8 includes a table 800 depicting a Coefficient of Performance (COP) comparison of different cooling systems. COP is a measure of the efficiency of a heating or cooling system. A higher COP suggests a more efficient heating or cooling system compared to a system with a lower COP. A COP associated with a cooling system is calculated differently from a COP associated with a heating system. For a heating system, the heating mode COP may be calculated by dividing an amount of heat energy produced by the heating system by the amount of work or electricity required to generate the amount of produced heat energy. For example, $COP_{heating}$ may be calculated by:

$$COP_{heating} = \frac{\text{Heat energy produced}}{\text{Energy required to produce heat}}$$

Similarly, the cooling mode COP may be calculated dividing an amount of cooling energy produced by the cooling system by the amount of work or electricity required to generate the amount of produced cooling energy. For example, COP cooling may be calculated by:

$$COP_{cooling} = \frac{\text{Cooling energy produced}}{\text{Energy required to produce cooling energy}}$$

The relationship between $COP_{heating}$ and $COP_{cooling}$ may be defined as:

$$COP_{cooling} = 1 - COP_{heating}$$

In column 802, with an ambient temperature of 20° C. or about 68° F., the efficiency of the different cooling system can be seen. For example, the transcritical CO2 cooling which with isochoric heating will have a COP of 5.45.

There are several variations, such as multi-stage cycles, related to systems and methods described herein that are apparent and are herein disclosed. For example, constant volume heating, which may be used for at least a portion of the vaporization stage, may be used for heating, cooling, systems that implement either or both, and/or related system. In examples discussed herein, constant volume heating is used with a working fluid undergoing a transcritical cycle. In these examples, at least a portion of the working fluid or fluid mixture becomes supercritical or is raised above the supercritical point of at least one of the mixture compounds, and at least a portion of the fluid or fluid mixture is expanded below the liquid saturation line or vapor saturation line.

The invention claimed is:

1. A method of a cooling cycle comprising:

compressing a refrigerant at a first state to a second state, the first state being at a first temperature and a first pressure, the second state being at a second temperature and a second pressure, the second temperature being higher than the first temperature, the refrigerant at the first state being at a predetermined bulk density;

cooling the refrigerant at the second temperature and the second pressure to a third temperature, the second temperature being less than the third temperature, the cooling of the refrigerant being at a constant pressure;

expanding the refrigerant at the third temperature and the second pressure to a fourth temperature, the fourth temperature being less than the third temperature, the fourth temperature corresponding to a third state where the refrigerant is at the predetermined bulk density; and heating the refrigerant at the fourth temperature to the first temperature at the predetermined bulk density that is constant from the third state to the first state.

2. The method of claim 1, wherein the cooling cycle is a transcritical cooling cycle.

3. The method of claim 1, further comprising recovering energy when expanding the refrigerant at the third temperature and the second pressure to the fourth temperature.

4. The method of claim 1, wherein during heating of the refrigerant at the fourth temperature to the first temperature at the predetermined bulk density, heat is transferred at a constant volume, vaporizing and pre-compressing the refrigerant.

5. The method of claim 1, wherein expanding the refrigerant at the third temperature and the second pressure to the fourth temperature is isentropic expansion.

6. The method of claim 1, wherein heating the refrigerant at the fourth temperature to the first temperature at the predetermined bulk density is isochoric heating.

7. The method of claim 1, wherein compressing the refrigerant at the first state to the second state comprises isentropic compression, and cooling the refrigerant at the second temperature and the second pressure to the third temperature is isobaric cooling.

8. The method of claim 1, wherein the refrigerant does not undergo a phase change when cooling the refrigerant at the second temperature and the second pressure to the third temperature.

9. The method of claim 1, where the refrigerant is carbon dioxide.

10. The method of claim 1, where the refrigerant is air or propane.

11. A system comprising:

a compressor configured to compress a refrigerant at a first state to a second state, the first state being at a first temperature and a first pressure, the second state being at a second temperature and a second pressure, the second temperature being higher than the first temperature, the refrigerant at the first state being at a predetermined bulk density;

a condenser configured to cool the refrigerant at the second temperature and the second pressure to a third temperature, the second temperature being less than the third temperature, the cooling of the refrigerant being at a constant pressure;

an expander configured to expand the refrigerant at the third temperature and the second pressure to a fourth temperature, the fourth temperature being less than the third temperature, the fourth temperature corresponding to a third state where the refrigerant is at the predetermined bulk density; and an evaporator comprising pistons and heating exchangers configured to heat the refrigerant at the fourth temperature to the first temperature at the predetermined bulk density that is constant from the third state to the first state.

12. The system of claim 11, wherein compressing, cooling, expanding, and heating the refrigerant is at least part of a transcritical cooling cycle.

13. The system of claim 11, wherein the expander is configured to recover energy when expanding the refrigerant at the third temperature and the second pressure to the fourth temperature.

14. The system of claim 11, wherein the evaporator is configured to transfer heat at a constant volume while vaporizing and pre-compressing the refrigerant to the first temperature at the predetermined bulk density.

15. The system of claim 11, wherein the expander is configured to perform isentropic expansion when expanding the refrigerant at the third temperature and the second pressure to the fourth temperature.

16. The system of claim 11, wherein the evaporator is configured to perform isochoric heating when heating the refrigerant at the fourth temperature to the first temperature at the predetermined bulk density.

17. The system of claim 11, wherein the compressor is configured to perform isentropic compression when compressing the refrigerant at the first state to the second state, and the condenser is configured to perform isobaric cooling when cooling the refrigerant at the second temperature and the second pressure to the third temperature.

18. The system of claim 11, wherein the refrigerant does not undergo a phase change when cooling the refrigerant at the second temperature and the second pressure to the third temperature.

19. The system of claim 11, where the refrigerant is carbon dioxide.

20. The system of claim 11, where the refrigerant is air or propane.

21. A method of a cooling cycle comprising:

compressing a refrigerant at a first state to a second state, the first state being at a first temperature and a first pressure, the second state being at a second temperature and a second pressure, the second temperature being higher than the first temperature, the refrigerant at the first state being at a first density;

cooling the refrigerant at the second temperature and the second pressure to a third temperature, the second temperature being less than the third temperature, the cooling of the refrigerant being at a constant pressure;

expanding the refrigerant at the third temperature and the second pressure to a fourth temperature, the fourth temperature being less than the third temperature, the fourth temperature corresponding to a third state where the refrigerant is at a predetermined bulk density;

heating the refrigerant at the fourth temperature to a fifth temperature at the predetermined bulk density that is constant from the third state to a fourth state using isochoric heating; and heating the refrigerant from the fourth state to the first state using isobaric vaporization.

* * * * *